US005845769A

United States Patent [19]

Yeager

[11] Patent Number: 5,845,769

[45] Date of Patent: Dec. 8, 1998

[54] STORAGE BAG WITH SOAKER PAD

[76] Inventor: James W. Yeager, 505 Cumberland Rd E., Mobile, Ala. 36608

[21] Appl. No.: 924,475

[22] Filed: Aug. 25, 1997

Related U.S. Application Data

[63] Continuation-in-part of Ser. No. 762,869, Dec. 12, 1996, which is a continuation-in-part of Ser. No. 632,320, Apr. 15, 1996, Pat. No. 5,660,868, which is a continuation of Ser. No. 276,882, Jul. 18, 1994, abandoned, which is a continuation of Ser. No. 909,106, Jul. 1, 1992, abandoned.

[51] Int. Cl.[6] ..... B65D 81/26

[52] U.S. Cl. ..... 206/204; 426/124; 426/129

[58] Field of Search ..... 206/204; 383/113; 426/124, 129; 493/189, 193–197

[56] References Cited

U.S. PATENT DOCUMENTS

| | | | |
|---|---|---|---|
| 2,537,196 | 1/1951 | Tanski | 206/205 |
| 2,545,710 | 3/1951 | Snyder | 206/204 |
| 3,156,402 | 11/1964 | Dupuis | 206/204 |
| 3,254,828 | 6/1966 | Lerner | 493/195 |
| 4,619,361 | 10/1986 | Thomas, Jr. | 206/204 |
| 4,742,908 | 5/1988 | Thomas, Jr. et al. | 206/204 |
| 4,815,590 | 3/1989 | Peppiatt et al. | 206/204 |
| 5,032,448 | 7/1991 | Mendenhall | 383/113 |
| 5,055,322 | 10/1991 | Rhodes et al. | 206/204 |
| 5,229,124 | 7/1993 | Rei et al. | 424/409 |
| 5,503,840 | 4/1996 | Jacobson et al. | 424/421 |
| 5,540,500 | 7/1996 | Tanaka | 383/43 |
| 5,564,561 | 10/1996 | Black et al. | 206/204 |
| 5,660,868 | 8/1997 | Yeager | 206/204 |

*Primary Examiner*—Jimmy G. Foster
*Attorney, Agent, or Firm*—David L. Ray

[57] ABSTRACT

A storage bag with soaker pad, and a material and method for making same. The bag of the invention includes a bag having a front and rear panel of a plastic film, the front and rear panels being closed at one end to form a bottom of the bag, the bag being open at the opposite end for receipt of goods to be stored in the bag, a fluid absorbing pad located inside the bag, and an enclosure connected to the inside of the bag for containing the fluid absorbing pad. The material of the invention comprises a bag film connected to a perforated enclosure material with a plurality of soaker pads sandwiched between the two layers. The width of the perforated enclosure material is substantially less than the width of the bag film whereby the soaker pads are continued to a limited space near the center of the material that creates the bottom fold of the resulting bags formed from the material. The method of making the bag of the invention includes a continuous supply of bag film be fed forwardly towards a bag machine. In unison with the movement of the bag film a layer of perforated enclosure material containing a plurality of soaker pads is connected at its edges to the bag film thereby sandwiching the storage pads between the two layers. The bag panels, enclosure, and soaker pad could be treated with antimicrobial agents for suppressing microorganisms that may be found in the liquids emanating from the goods stored inside the bag.

20 Claims, 8 Drawing Sheets

STORAGE BAG WITH SOAKER PAD

CROSS REFERENCE TO RELATED APPLICATION

This application is a continuation-in-part of my co-pending application Ser. No. 08/762,869 filed Dec. 12, 1996, pending, which is a continuation-in-part of my application Ser. No. 08/632,320 filed Apr. 15, 1996, now U.S. Pat. No. 5,660,868, which is a continuation of my application Ser. No. 08/276,882 filed Jul. 18, 1994, now abandoned, which is a continuation of my application Ser. No. 07/909,106 filed Jul. 1, 1992, now abandoned.

BACKGROUND OF THE INVENTION

1. Field of the Invention

The invention relates to storage bags. More particularly, the present invention relates to storage bags having soaker pads made from materials containing antimicrobial agents therein for absorbing and suppressing the growth of microorganisms within the fluids which flow from products contained in the bags, plastic film containing antimicrobial agents therein and having soaker pads thereon for making film with soaker pads thereon and bags with soaker pads therein, and methods and apparatus for making same.

2. Description of the Related Art

Storage bags and soaker pads are known in the art. Exemplary of such bags and soaker pads are those disclosed in the following U.S. Patents:

U.S. Pat. No. 5,055,332 discloses an absorbent pad and method for constructing same for meat and poultry products and the like. The absorbent pad includes upper and lower plastic film layers, at least one of which is perforated, and an intermediate absorbent pad includes upper and lower plastic film layers, at least of which is perforated, and an intermediate absorbent layer includes a series of juxtaposed and overlapping absorbent material fibers with superabsorbent granules dispersed throughout the absorbent layer and supported by the absorbent material fibers of one or several types, even when the absorbent material fibers have liquid therein. The superabsorbent granules are fixed and held in place by structurally interacting absorbent material fibers and/or by attachment to one or more of the types of absorbent material fibers constituting the absorbent layer. The upper and lower layers are attached to one another at least partially along opposite marginal edge portions thereof to retain the absorbent layer between the upper and lower layers. The superabsorbent granular particles are homogeneously dispersed throughout the absorbent layer and supported in generally spaced relationship within the interstices of the absorbent material fibers, to enable suspension and retention of liquid by the superabsorbent granules and absorbent material fibers.

U.S. Pat. No. 4,861,632 discloses a laminated bag which is a packaging material from which package type containers are fabricated for storing or transporting a variety of products ranging from dry food-stuffs to electronic equipment where maintenance of dry environment is a requirement, including an outer imperforate water impervious layer, a middle layer of absorbent material and an inner perforated moisture impervious layer.

U.S. Pat. No. 4,815,590 discloses a plastic bag with absorbent insert for packaging articles including fresh meats and the like which has an absorbent insert attached to the interior surface of the rear panel of the bag. The insert is generally rectangular and is attached to the rear panel along the side closest to the bag opening so that the insert cannot be dislodged when the bag is filled. The insert absorbs blood and other fluids in the meats to keep the package neat and clean and minimize the danger of leakage.

U.S. Pat. No. 4,756,939 discloses an absorbent pad for use in packaging food products which is adapted for placement in a package beneath a food product having a tendency to exude fluid. The pad includes a mat of fluid absorbent material having two oppositely facing substantially flat surfaces with side portions, and a cover, made from a liquid impermeable material enclosing the mat, having two oppositely facing substantially flat imperforate surfaces, corresponding with the oppositely facing surfaces of the mat, and side portions corresponding with the side portions of the mat. At least two of the side portions of the cover have a plurality of perforations along their extent to permit passage of the exuded material through the cover for absorption by the mat.

U.S. Pat. No. 4,742,908 discloses a bag with a soaker pad for packaging and displaying meat or poultry having a front and rear thermoplastic panel joined at a fold line at the bottom of the bag. An absorbent pad, having a non-stick layer, and absorbent layer and a securing device, is positioned at the bottom of the bag. The pad extends over both the front and rear panels and is secured to the panels. An opaque printing is provided on the panels and corresponds generally to the position of the pad.

U. S. Pat. No. 4,735,308 discloses a compound food storage bag which is an internally lined food storage bag useful in the storage of moisture-retentive foods such as fruits and vegetables. The storage bag includes a hand-closed water-impermeable outer bag containing an absorbent inner bag. The inner bag is made of water absorbent paper or paper-like material attached to the bottom and in small areas (i.e., spots) only part of the way up the interior of the outer bag, thereby enabling separate closure.

U.S. Pat. 4,629,064 discloses a compound food storage bag which is useful in the storage of moisture-retentive foods such as fruits and vegetables. The storage bag includes a hand-closed water impermeable outer bag containing an absorbent inner bag. The inner bag is made of water absorbent paper of paper-like material attached at the bottom and in small areas (i.e. spots) only part of the way up the interior of the outer bag, thereby enable separate closure.

U.S. Pat. No. 4,619,361 discloses a bag for displaying food having a front and rear thermoplastic panel joined at a fold line at the bottom of the bag. An absorbent pad, having two impervious non-stick layers sandwiching a non-woven absorbent layer, is positioned at the bottom of the bag. The pad extends over both the front and rear panels and is thermally welded to the panels. An opaque printing is provided on the panels and corresponds generally to the position of the pad.

U.S. Pat. No. 4,410,578 discloses a receptacle for moisture exuding food products including an absorbent pad for use in a receptacle intended to contain and display food products which tend to exude juices or liquids. The absorbent pad includes a mat of liquid absorbent material, and upper liquid impermeable plastic sheet overlying the absorbent mat, and a bottom plastic sheet underlying the absorbent mat, and a bottom plastic sheet underlying the absorbent mat. At least one of the sheets is perforated, and a spacer is disposed between the two sheets to maintain their separation under a compressive load, and such that the ability of the pad to absorb liquids is unimpaired when the pad is subjected to a compressive load resulting from the food product resting thereon or the like. Preferably only the bottom sheet is perforated, and when a food product is positioned upon the upper sheet of the absorbent pad, any exuded liquids will flow around the pad and enter the mate by capillary action through the perforated openings of the bottom sheet, and the liquids will be held out of contact with the food product to thereby minimize contamination of the product and maintain its appearance and improve its shelf-life.

U.S. Pat. No. 4,401,213 discloses a container strip having inserted elements or material which have an effect on contents which may be disposed in a container and/or enhance the package. In one embodiment the insert has anti-corrosion properties. After corrosion-susceptible products have been sealed within the container, chemicals in the insert create a protective environment for the products. By providing inserts with other appropriate chemical constituents, other desirable effects can be created. In an alternative embodiment, an insert can be used in a header portion of the container to provide support for display purposes.

U.S. Pat. No. 4,382,507 discloses an absorbent pad which is useful in a receptacle for containing and displaying food products which tend to exude juices or liquids. The absorbent pad includes a mat of liquid absorbent material, which includes a layer of paper wadding and a layer of wood fluff, with the layers being mechanically interconnected. A plastic liquid impermeable sheet overlies one side of the mat, and a plastic perforated sheet overlies the other side. When the food product is positioned upon the upper sheet of the absorbent pad, any exuded liquids will flow around the pad and enter the mat by capillary action through the perforated openings of the bottom sheet, and the liquids will be held out of contact with the food product to thereby minimize contamination of the product and maintain its appearance and improve its shelf-life. The pad also has independent utility as a moisturizing device for use in closed food containers or packages.

U.S. Pat. No. 4,321,997 discloses a receptacle for moisture-exuding food products which tend to exude juices or liquids, and which includes a supporting member, such as a tray or bag, and an absorbent pad associated therewith. The absorbent pad includes a mat of liquid absorbent material, an upper liquid impermeable plastic sheet overlying the absorbent mat. At least one of the sheets is perforated, and a spacer is disposed between the two sheets to maintain their separation under a compressive load, and such that the ability of the pad to absorb liquids is unimpaired when the pad is subjected to a compressive load resulting from the food product resting thereon or the like. Preferably only the bottom sheet is perforated, and when a food product is positioned upon the upper sheet of the absorbent pad, and exuded liquids will flow around the pad and enter the mat by capillary action through the perforated openings of the bottom sheet, and the liquids will be held out of contact with the food product to thereby minimize contamination of the product and maintain its appearance and improve its shelf-like.

U.S. Pat. No. 4,275,811 discloses a receptacle for containing and displaying food products which tend to exude juices or liquids, and which includes a supporting member, such as a tray or bag, and an absorbent pad associated therewith. The absorbent pad includes a mat of liquid absorbent material, an upper liquid impermeable sheet overlying the absorbent mat, and a perforated bottom sheet underlying the absorbent mat. When a food product is positioned upon the upper sheet of the absorbent pad, and exuded liquids will flow around the pad and enter the mat by capillary action through the perforated openings of the bottom sheet, and the liquids will be held out of contact with the food product to thereby minimize contamination of the product and maintain its appearance and improve its shelf-life. The pad also has independent utility as a moisturizing device for use in closed food containers or packages.

U.S. Pat. No. 3,156,402 discloses a liquid absorbing and concealing device for containing juice exuding product such as meat or poultry, including a tray formed from substantially moisture resistant and opaque material and having a flat bottom surface, a flat sheet of thin substantially moisture resistant and opaque material placed in the tray to rest on the flat bottom surface thereof with a liquid absorbing capillary gap existing between the sheet and the flat bottom surface, the sheet having a plurality of small juice absorbing openings therethrough spaced substantially over the entire area thereof.

U.S. Pat. No. 2,537,196 discloses a humidor tobacco pouch including a double sheet of pliable, waterproof material, all edges of which are attached to each other, the lower portion of the double sheet being folded upon itself and the edges thereof being attached to the edges of the unfolded portion of the sheet, thus forming a pocket for a substance to be maintained at a predetermined humidity, the inner sheet of the rear wall of the pocket having perforations therethrough and the outer sheet of the front wall having a transverse slit therethrough, thereby forming a single thickness walled pocket positioned forwardly to the first mentioned pocket for a moisture-containing element, and the rear wall of the forwardly to the first mentioned pocket for a moisture-containing element, and the rear wall of the forwardly positioned pocket having perforations therethrough, the perforations in both instances being adapted for transferring moisture from the element to the substance whereby the substance is substantially evenly humidified.

SUMMARY OF THE INVENTION

In accordance with the present invention there is provided a storage bag with soaker pad. The bag of the invention includes a bag having a front and rear panel of a plastic film, the front and rear panels being closed at one end to form a bottom of the bag, the bag being open at the opposite end for receipt of goods to be stored in the bag, a fluid absorbing pad located inside the bag, and an enclosure connected to the inside of the bag for containing the fluid absorbing pad.

An important object of the present invention is to provide a method for making film with soaker pads thereon and storage bags with soaker pads therein.

An even further object of the present invention is the incorporation of antimicrobial agents into the bag components, that is, the plastic film used to form the bag panels and the enclosure, and the materials utilized to make the soaker pad. In accordance with the present invention, a continuous supply of bag film is fed forward to a bag making machine. Prior to entering the machine, soaker pads are placed onto the surface of the film at the locations corresponding to each resulting bag to be formed from the film. A continuous web of perforated enclosure material is fed forward in unison with the bag film and is secured to the bag film creating an enclosure that covers the soaker pads resulting in a multilayered film with pre-applied soaker pads sandwiched between its layers prior to being formed into a plurality of storage bags with soaker pads.

Pursuant to the principles of the present invention there is provided a new and improved storage bag with soaker pad wherein the bag has an enclosure that accomplishes a variety of tasks such as limiting the soaker pad's movement and protecting the soaker pad from becoming dislodged by the product within the bag, preventing the need to attach the soaker pad to the panels of the pad making it possible to utilize soaker pads that cannot be attached to common bag materials using conventional securing techniques, and creating a reservoir for trapping most of the fluids squeezed out the soaker pad to a confined location within the bag. In addition the improved storage bag with soaker pad containing antimicrobial agents has the ability to suppress or kill the growth of microorganism that may be present in the fluids emanating from the products stored within.

BRIEF DESCRIPTION OF THE PREFERRED EMBODIMENTS

Figure 1:
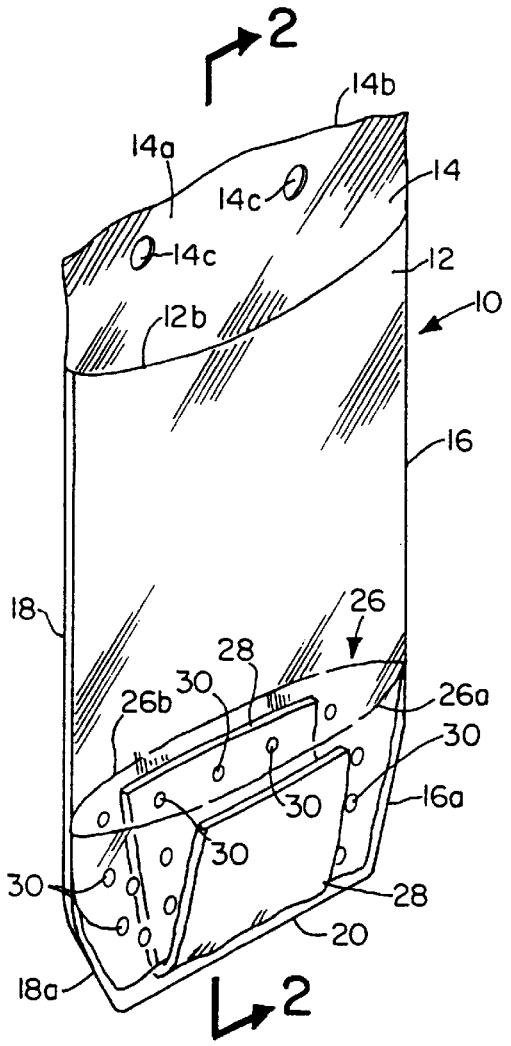
FIG. 1 is a perspective view of a first embodiment of the bag of the present invention.
Figure 2:
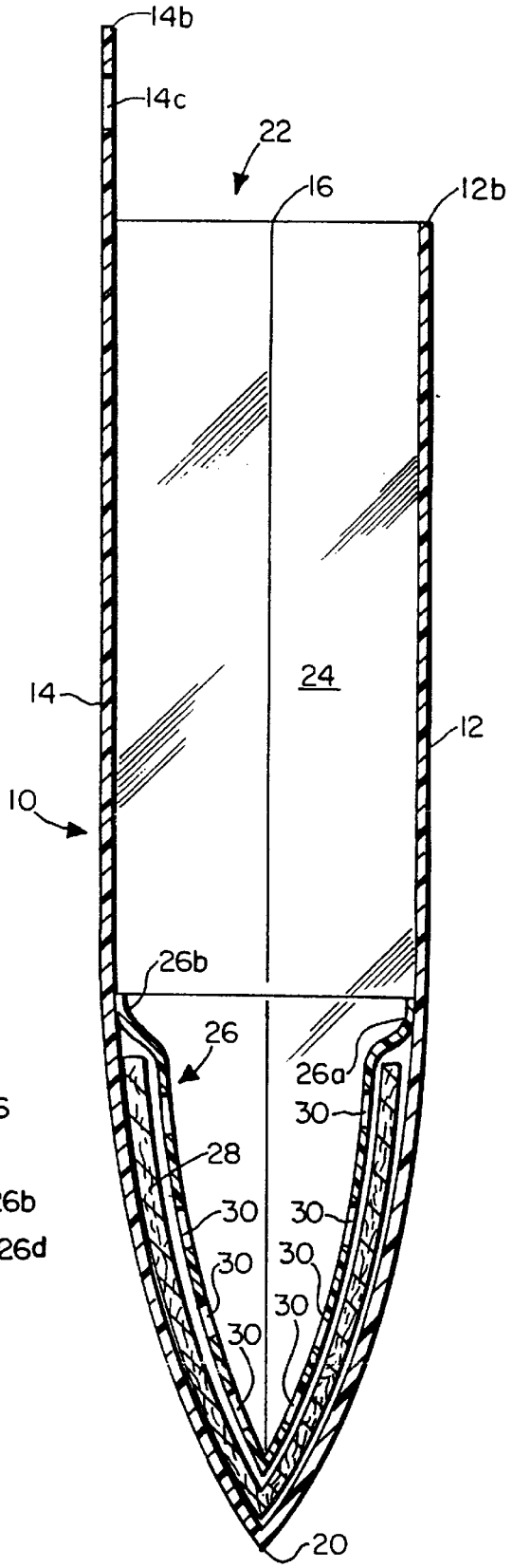
FIG. 2 is a cross sectional view taken along lines 2—2 of FIG. 1.

Referring now to the drawings, in FIGS. 1 and 2 is shown a first embodiment of the storage bag of the invention generally indicated by the numeral 10. Bag 10 has a front panel 12 and a rear panel 14 which are preferably made from a single, integral piece of plastic film. Front panel 12 is joined to rear panel 14 by side seams 16 and 18 and by bottom fold 20. Side seams 16 and 18 have lower tapered portions 16*a* and 18*a* could be deleted and seams 16 and 18 could intersect bottom 20 perpendicularly if desired. Furthermore, rather than being formed in a straight line, the lower tapered portions 16*a* and 18*a* could be shaped like an arc or a portion of an ellipse.

Front panel 12 has a top edge 12*b* which is not connected to rear panel 14, and rear panel 14 has a top edge 14*b* which is not connected to front panel 12. Top edge 14*b* is located at a distance above top edge 12*b* to form lip 14*a*. Rear panel may have wicket holes 14*c* adjacent the top edge 14*b* if desired for stacking the bags as is known in the art. If desired, top edge 12*b* and top edge 14*b* could lie immediately adjacent to each other, and lip 14*a* and wicket holes 14*c* could be eliminated.

Thus, an opening 22 shown in FIG. 2 is formed in the top end of bag 10. Goods such as poultry, beef, vegetables, chemicals, blood or pathological specimens, or any other fluid exuding item may be inserted into the inside 24 of bag 10 through opening 22. Preferably, bag 10 is used to contain and store poultry. The poultry may be whole such as a cleaned and dressed chicken, or the poultry may be cut into pieces such as chicken quarters, or thighs, drumsticks, or wings.

Located inside bag 10 is an enclosure made from plastic film generally indicated by the numeral 26 for loosely containing the fluid absorbing pad 28 and liquids emanating from goods stored in bag 10. Although it is preferred that fluid absorbing pad 28 may be loosely contained or held in enclosure 26 and therefore be free to move therein, pad 28 could be connected to enclosure 26 to prevent movement therein if desired.

Enclosure 26 is connected at seam 26*a* to front panel 12 and at seam 26*b* to rear panel 14. Preferably, enclosure 26 is connected along its sides 26*c* and 26*d* shown in FIG. 3 to side seams 16 and 18 of bag 10 and to tapered portions 16*a* and 18*a*. However, if desired, enclosure 26 could be narrower than the width of bag 10.

In FIG. 1 and 2, seams 26*a* and 26*b* are shown connected to front panel 12 and rear panel 14, respectively, at approximately the same distance from the bottom fold 20 of bag 10. If desired, seam 26*b* could be located a greater distance from the bottom fold 20 than seam 26*a* to coincide with the borders of printed matter that may appear on the front panel 12 of bag 10. Furthermore, if desired, seam 26*a* or 26*b* could be located adjacent to bottom fold 20.

Fluid absorbing pad 28 is also referred to in the art, and sometimes herein, as a "soaker pad". Soaker pads are well known in the art and may be made from a variety of fluid absorbing materials. Soaker pad 28 may be made from manufactured or synthetic fibers, or natural fibers, or a combination thereof, either woven or non-woven, which are secured or attached to each other. Preferably, the absorbent material fibers of the fluid absorbing pad or soaker pad 28 are formed from cellulose materials such as paper or the like.

It is not necessary that the soaker pad 28 be covered with plastic film as disclosed in U.S. Pat. No. 5,055,332 and the like, because the soaker pad utilized in the present invention is contained in plastic film enclosure 26 and will not come in direct contact with the goods contained in bag 10. Thus, inexpensive soaker pads 28 made from absorbent materials having no plastic film cover attached thereto may be used in the bag 10 of the present invention.

Enclosure 26 has a plurality of perforations 30 which are substantially uniform over its full area. The perforations 30 permit liquids to travel therethrough from the goods contained in bag 10 to the soaker pad 28. Soaker pad 28 absorbs and retains the liquids from the goods. Furthermore, some of the liquids which may not be absorbed or retained by soaker pad 28 are retained within the enclosure 26 which functions as a fluid sump or reservoir.

Figure 3:
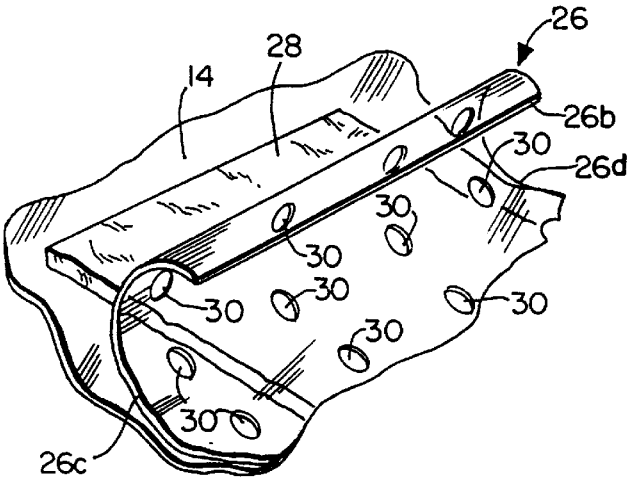
FIG. 3 is a perspective view of a portion of the bottom of the bag shown in FIG. 1 during construction thereof.

Enclosure 26 shown in FIG. 1–3 is preferably treated with antimicrobial agents to suppress or kill bacteria, fungus, and algae such as Staphylococcus, Psiudomonas, Proteus, *Escherichia coli*, Salmonella, Streptococcus, Enterobacter, Bacillus, Chaitomium, Myrothecium, Aspergillus, Penecillium, Fusarium, Alternaria, Aureobasidium, and other known microorganisms that may be found in the fluids or liquids emanating from the goods stored inside bag 10. Enclosure 26 acts as a microbial filter within bag 10 whereby some or all of the microorganisms found in the liquids passing therethrough are killed so that any liquids that are trapped therein are prevented from causing spoilage or contamination to the stored product. This novel feature of bag 10 is an important advance in the art of packaging where the products being stored in bag 10 must be kept free from potentially dangerous or hazardous microorganisms. It will be appreciated by those in the art that bag 10 with its unique perforated enclosure 26 that has been treated with antimicrobial agents, so as, to act as a microbial filter to eliminate some or all of the microorganisms present within bag 10 solves a well known problem.

Enclosure 26 can be conveniently treated with antimicrobial agents by blending concentrates such as Ultra-Fresh DM-50 or 95 directly into the raw materials used to produce the enclosure film, by preferably utilizing the polymeric extrusion process. Ultra-Fresh 95 is a registered trademark of Thompson Research Associates of Toronto, Canada a division of Kroy Wools Ltd. and is a concentrated additive composed of active ingredients including Diiodomethyl-p-toyl sulfone. Ultra-Fresh DM-50 is a registered trademark of Thompson Research Associates and Kroy Wools Ltd. and is a concentrated additive composed of active ingredients including Tri-n-butyltin maleate. Other well know additives can be utilized as the antimicrobial agent of the present invention such as products supplied by Microban Products Company of Huntsville, N.C. The amount of concentrate to be added to a particular polymer blend for the control of specific microorganisms such any of those listed above should be recommended by the additive supplier such as Thompson Research Associates or Microban Products Company.

The soaker pad 28 shown in FIG. 1–3 could be treated with antimicrobial agents to control the spread of microorganism such as those specifically listed above by using the techniques previously described for treating enclosure 26 of FIG. 1–3. Although the materials that form the absorbent medium of soaker pad 28 could be treated by utilizing concentrates containing the active ingredients such as Diiodomethyl-p-toyl sulfone and Tri-n-butyltin maleate other additives and methods for treating soaker pad 28 also are known in the art and therefore could be utilized as well.

Figure 4:
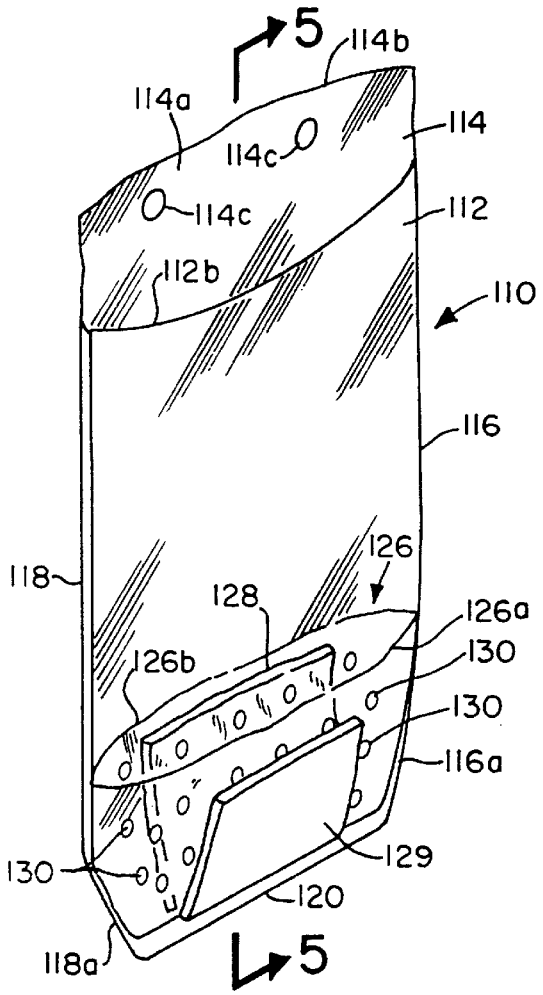
FIG. 4 is a perspective view of a second embodiment of the bag of the present invention.
Figure 5:
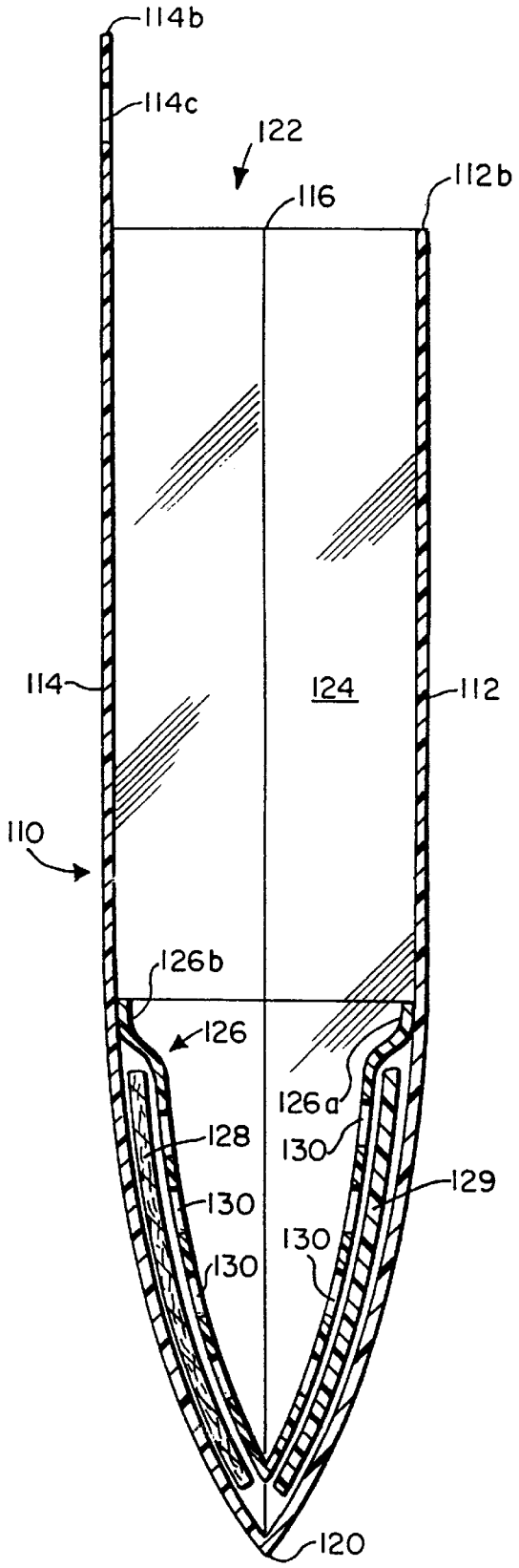
FIG. 5 is a cross sectional view taken along lines 5—5 of FIG. 4.

Referring now to FIGS. 4 and 5, there is shown a second embodiment of the storage bag of the invention generally indicated by the numeral 110. Bag 110 has a front panel 112 and a rear panel 114 which are preferably made from a single, integral piece of plastic film. Front panel 112 is joined to rear panel 114 by side seams 116 and 118 and by bottom fold 120. Side seams 116 and 118 have lower tapered portions 116*a* and 118*a*, respectively. However, the lower tapered portions 116*a* and 118*a* could be deleted and seams 116 and 118 could intersect bottom 120 perpendicularly if desired. Furthermore, rather than being formed in a straight line, the lower tapered portions 116*a* and 118*a* could be shaped like an arc or a portion of an ellipse.

Front panel 112 has a top edge 112*b* which is not connected to rear panel 114, and rear panel 114 has a top edge 114*b* which is not connected to front panel 112. Top edge 114*b* is located at a distance above top edge 112*b* to form lip 114*a*. Rear panel may have wicket holes 114*c* adjacent the top edge 114*b* if desired for stacking the bags as is known in the art. If desired, top edge 112*b* and top edge 114*b* could lie immediately adjacent to each other, and lip 114*a* and wicket holes 114*c* could be eliminated.

Thus an opening 122 shown in FIG. 5 is formed in the top end of bag 110. Goods such as poultry, beef, vegetables, or any other fluid exuding item may be inserted into the inside 124 of bag 110 through opening 122. Preferably, bag 110 is used to contain and store poultry. The poultry may be whole such as a cleaned and dressed chicken, or the poultry may be cut into pieces such as chicken quarters, or thighs, drumsticks, or wings.

The bag panels 112 and 114 of bag 110 as shown in FIG. 4 and 5 could be treated with antimicrobial agents to control the spread of microorganism such as those specifically listed above by using the techniques previously described for treating enclosure 26 of FIG. 1–3.

Located inside bag 110 is enclosure made from plastic film generally indicated by the numeral 126 for loosely containing the fluid absorbing pad 128, non-absorbent spacer pad 129, and liquids emanating from goods stored in bag 110. Non-absorbent spacer pad 129 maintains a space or distance between front panel 112 and enclosure 126 so that liquids may collect between front panel 112 and enclosure 126 and travel to pad 128. Although it is preferred that fluid absorbing pad 128 and non-absorbent spacer pad 129 may be loosely contained or held in enclosure 126 and therefore be free to move therein, pads 128 and 129 could be connected to enclosure 126 to prevent movement therein if desired.

Enclosure 126 is connected at seam 126*a* to front panel 112 and at seam 126*b* to rear panel 114. Preferably, enclosure 126 is connected along its sides in the same manner as enclosure 26, shown in FIGS. 1, 2, and 3, to side seams 116 and 118 of bag 110 and to tapered portions 116*a* and 118*a*. However, if desired, enclosure 126 could be narrower than the width of bag 110.

In FIG. 4 and 5, seams 126*a* and 126*b* are shown connected to front panel 112 and rear panel 114, respectively, at approximately the same distance from the bottom fold 120 of bag 110. If desired, seam 126*b* could be located a greater distance from the bottom fold 120 than seam 126*a* to coincide with the borders of printed matter that may appear on the front panel 112 of bag 110. Furthermore, if desired, seam 126*a* or 126*b* could be located adjacent to bottom fold 120.

Fluid absorbing pad 128 is also referred to in the art, and sometimes herein, as a "soaker pad". Soaker pad 128 may be constructed from the same materials and in the same manner as soaker pad 28 in FIGS. 1–3.

The soaker pad 128 shown in FIG. 4 and 5 could be treated with antimicrobial agents to control the spread of microorganism such as those specifically listed above by using the techniques previously described for treating enclosure 26 of FIG. 1–3.

Enclosure 126 has a plurality of perforations 130 which are substantially uniform over its full area. The perforations 130 permit liquids to travel therethrough from the goods contained in bag 110 to the soaker pad 128. Soaker pad 128 absorbs and retains the liquids from the goods. Furthermore, some of the liquids which may not be absorbed or retained by soaker pad 128 are retained within the enclosure 126 which functions as a fluid sump or reservoir.

Enclosure 126 shown in FIG. 4 and 5 is preferably treated with antimicrobial agents to control the spread of microorganism such as those specifically listed above by using the techniques previously described for treating enclosure 26 of FIG. 1–3.

Figure 6:
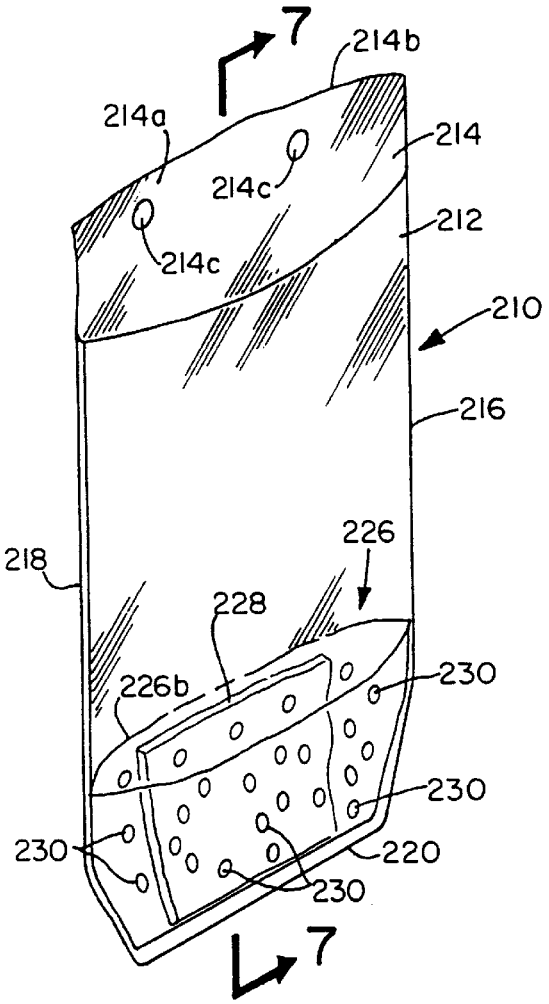
FIG. 6 is a perspective view of a third embodiment of the bag of the present invention.
Figure 7:
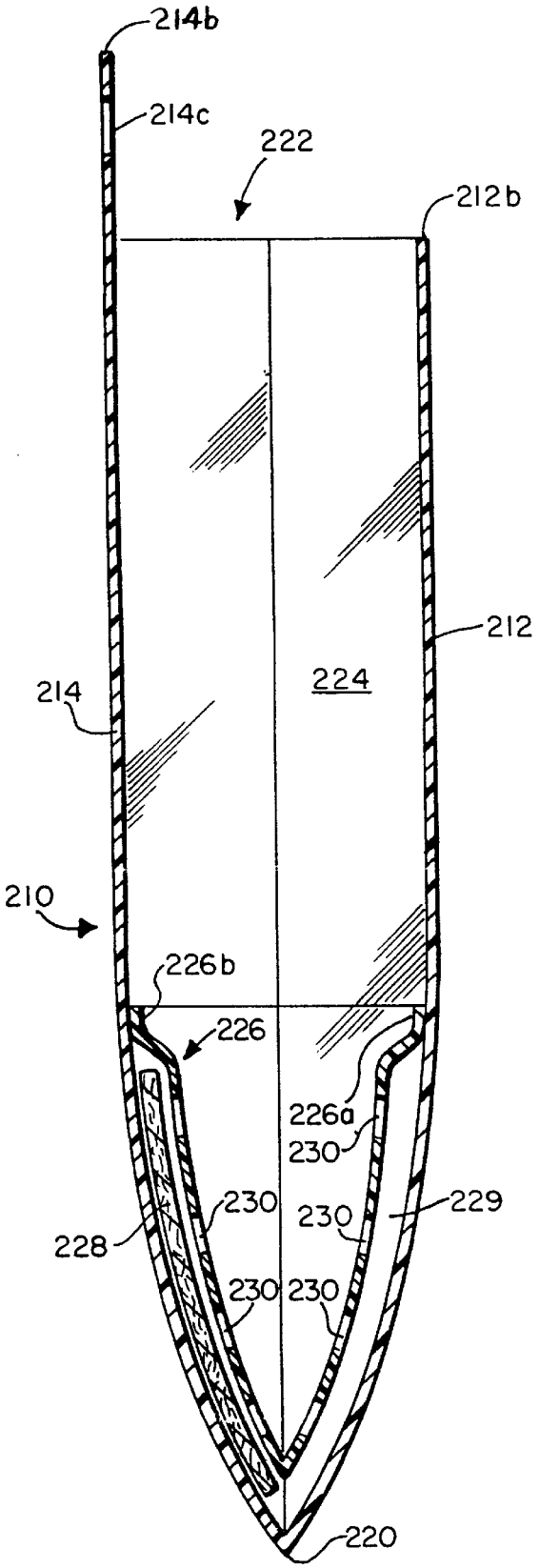
FIG. 7 is a cross sectional view taken along lines 7—7 of FIG. 6.

Referring now to FIGS. 6 and 7, there is shown a third embodiment of the storage bag of the invention generally indicated by the numeral 210. Bag 210 has a front panel 212 and a rear panel 214 which are preferably made from a single, integral piece of plastic film. Front panel 212 is joined to rear panel 214 by side seams 216 and 218 and by bottom fold 220. Side seams 216 and 218 have lower tapered portions 216*a* and 218*a*, respectively. However, the lower tapered portions 216*a* and 218*a* could be deleted and seams 216 and 218 could intersect bottom 200 perpendicularly if desired. Furthermore, rather than being formed in a straight line, the lower tapered portions 216*a* and 218*a* could be shaped like an arc or a portion of an ellipse.

Front panel 212 has a top edge 212*b* which is not connected to rear panel 214, and rear panel 214 has a top edge 214*b* which is not connected to front panel 212. Top edge 214*b* is located at a distance above top edge 212*b* to form lip 214*a*. Rear panel may have wicket holes 214*c* adjacent the top edge 214*b* if desired for stacking the bags as is known in the art. If desired, top edge 212*b* and top edge 214*b* could lie immediately adjacent to each other, and lip 214*a* and wicket holes 214*c* could be eliminated.

Thus, an opening 222 shown in FIG. 7 is formed in the top end of bag 210. Goods such as poultry, beef, vegetables, or any other fluid exuding item may be inserted into the inside 224 of bag 210 through opening 222. Preferably, bag 210 is used to contain and store poultry. The poultry may be whole, such as a cleaned and dressed chicken, or the poultry may be cut into pieces such as chicken quarters, or thighs, drumsticks, or wings.

Bag panels 212 and 214 of bag 210 shown in FIG. 6 and 7 could be treated with antimicrobial agents, to control the spread of microorganism found in bag 210, by using the techniques previously described for treating enclosure 26 of FIG. 1–3.

Located inside bag 210 is an enclosure made from plastic film generally indicated by the numeral 226 for loosely containing the fluid absorbing pad 228, and liquids emanating from goods stored in bag 210. Fluid absorbing pad 228 is placed between the rear panel 214 and the enclosure 226. A space or reservoir 229 exist between front panel 212 and enclosure 226 in space 229. Although it is preferred that fluid absorbing pad 228 may be loosely contained or held in enclosure 226 and therefore be free to move therein, pads 228 and 229 could be connected to enclosure 226 to prevent movement therein if desired.

Enclosure 226 is connected at seam 226*a* to front panel 212 and at seam 226*b* to rear panel 214. Preferably, enclosure 226 is connected along its sides in the same manner as enclosure 26, shown in FIGS. 1, 2, and 3, to side seams 216 and 218 of bag 210 and to tapered portions 216*a* and 218*a*. However, if desired, enclosure 226 could be narrower than the width of bag 210.

In FIG. 6 and 7, seams 226*a* and 226*b* are shown connected to front panel 212 and rear panel 214, respectively, at approximately the same distance from the bottom fold 220 of bag 210. If desired, seam 226*b* could be located a greater distance from the bottom fold 220 than seam 226*a* to coincide with the borders of printed matter that may appear on the front panel 212 of bag 210. Furthermore, if desired, seam 226*a* or 226*b* could be located adjacent to bottom fold 220.

Fluid absorbing pad 228 is also referred to in the art, and sometimes herein, as a "Osaka pad". Soaker pad 228 may be constructed from the same materials and in the same manner as soaker pad 28 in FIGS. 1–3.

The soaker pad 228 shown in FIG. 6 and 7 could be treated with antimicrobial agents to control the spread of microorganism such as those specifically listed above by using the techniques previously described for treating enclosure 26 of FIG. 1–3.

Enclosure 226 has a plurality of perforations 230 which are substantially uniform over its full area. The perforations 230 permit liquids to travel therethrough from the goods contained in bag 210 to the soaker pad 228. Soaker pad 228 absorbs and retains the liquids from the goods. Furthermore, some of the liquids which may not be absorbed or retained by soaker pad 228 are retained within the enclosure 226 and reservoir 229 which functions as a fluid sump or reservoir.

The enclosure 226 as shown in FIG. 6 and 7 is preferably treated with antimicrobial agents to control the spread of microorganism such as those specifically listed above by using the techniques previously described for treating enclosure 26 of FIG. 1–3.

Figures 8, 8A:
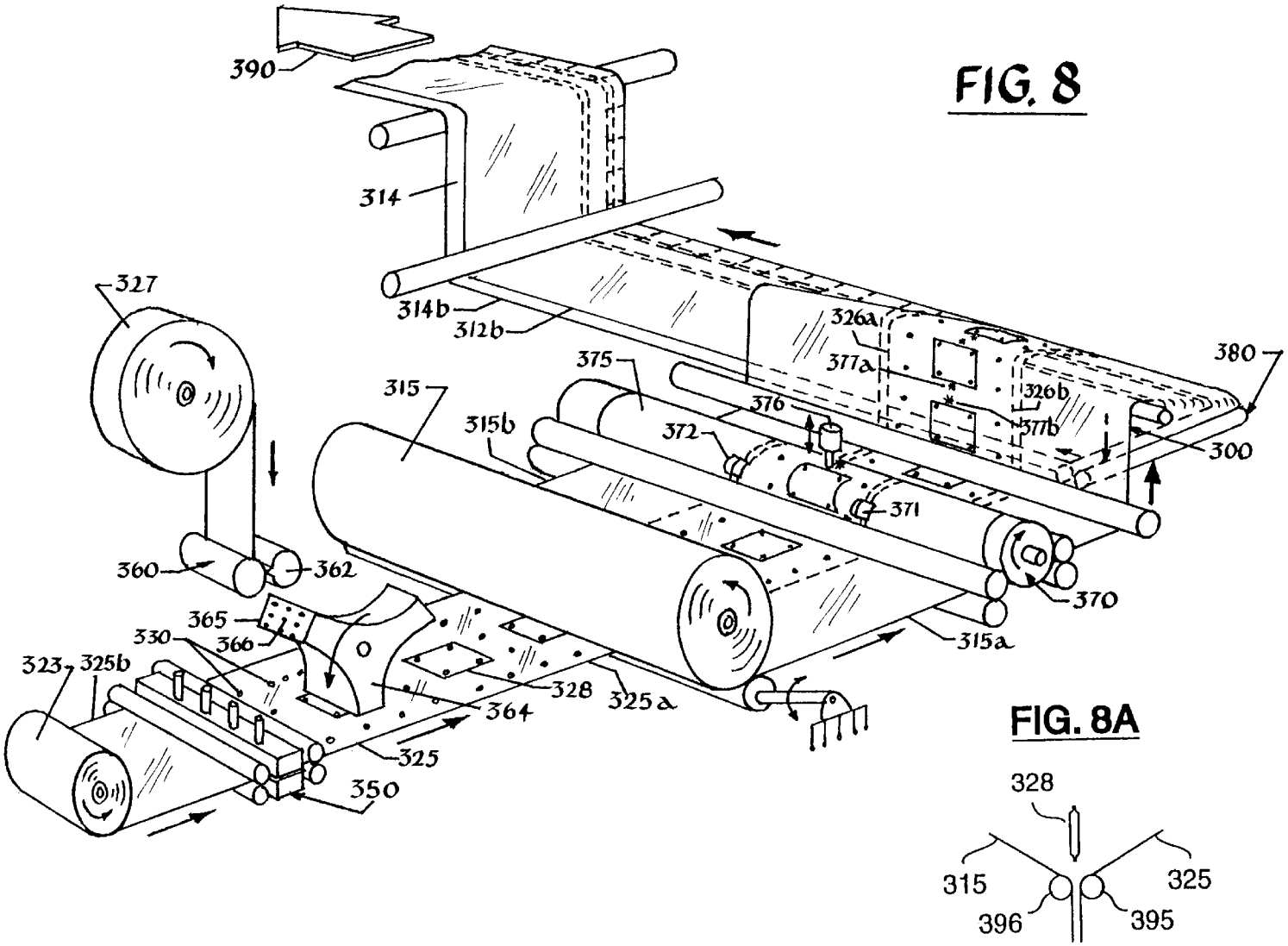
FIG. 8 is a perspective view of the method for making film with soaker pads thereon and storage bags with soaker pads therein.
FIG. 8A is a schematic view of an alternate method of positioning the soaker pad between the enclosure material and the bag film.
Figure 9:
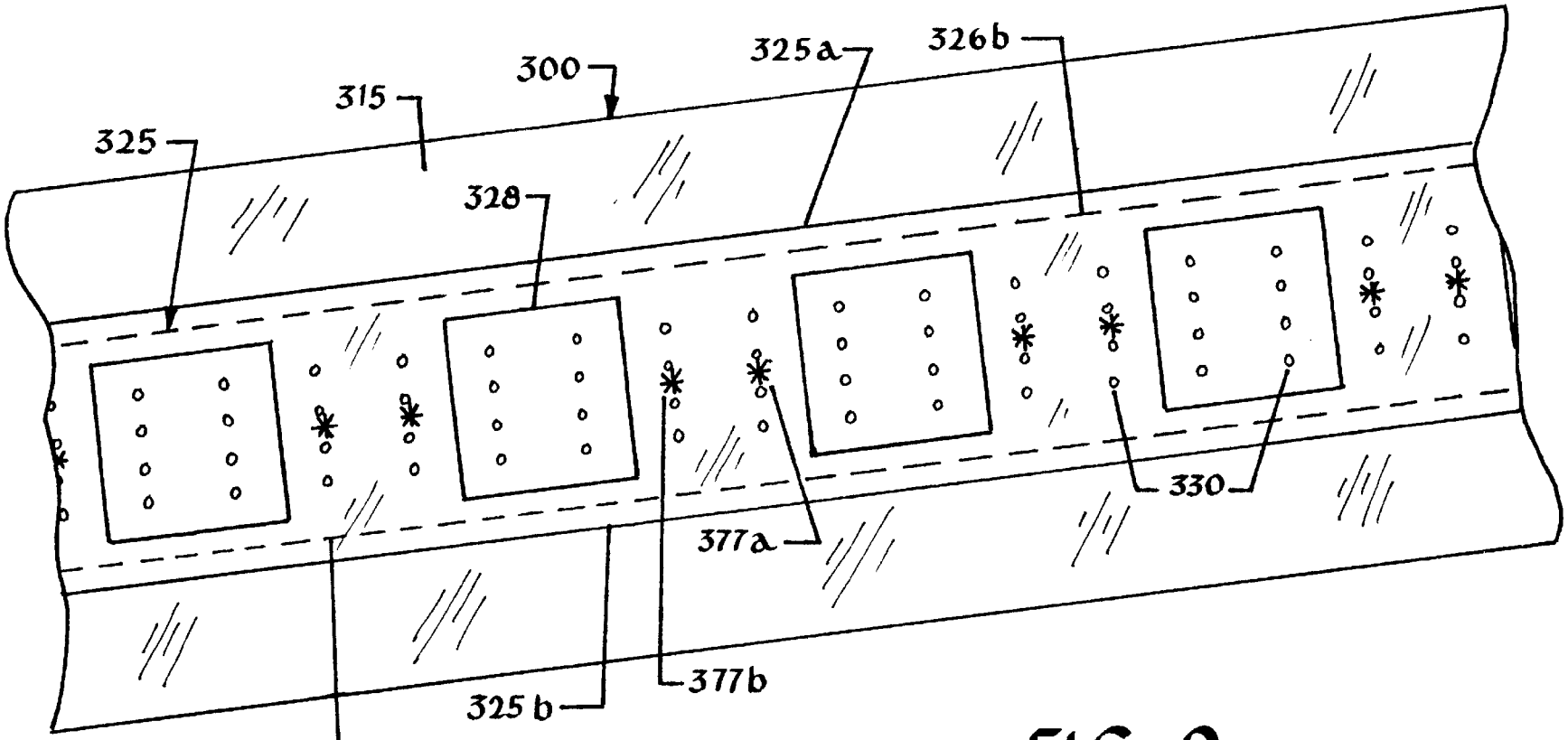
FIG. 9 is a perspective view of the film with soaker pads sandwiched between the bag film and the perforated enclosure material web.

In FIG. 8 is shown the preferred method of producing soaker pad web material 300 shown in FIG. 9 with soaker pads 328 sandwiched between bag film 315 and perforated enclosure material 325. The preferred method of producing soaker pad web material 300 requires a continuous supply of opaque perforated plastic enclosure material 325 be fed forwardly in a bag forming direction. Perforated enclosure material 325 could be produced by feeding a transparent or opaque plastic web material 323 through a mechanism 350 capable of creating perforated holes 330 through material 323. Mechanisms such as mechanism 350 are well known in the art whereby the perforated holes 330 are normally produced by mechanical punching or electrically burning through the web material in the desired locations. Any device known in the art for producing perforated film could be used with the present invention.

After plastic web material 323 has been perforated producing perforated enclosure material 325, soaker pads 328 are individually cut from preferably a continuous roll of soaker pad material 327 by mechanism 360 and placed upon the perforated enclosure material 325 as it is moved forward. Mechanism 360 includes preferably a rotary cutting device 362 for feeding and cutting off enough soaker pad material 327 to produce soaker pads 328. Soaker pads 328 after being cut off of the roll of soaker pad material 327 are preferably moved from rotary cutter 362 and positioned on perforated enclosure material 325 by vacuum wheel 364 which creates suction pressure at vacuum wheel head 365 through vacuum holes 366. As vacuum wheel 364 rotates the suction pressure decreases so that the soaker pad 328 is released from the vacuum head 365 and deposited onto the perforated enclosure material 325 in the desired location. Mechanisms such as mechanisms 360 and 364 are well know in the art. Other mechanisms well known in the art for delivering and positioning soaker pads onto a surface could also be used, such as mechanisms that deliver and position precut soaker pads from a magazine. Any device known in the art for cutting and supplying soaker pads onto a surface could be used with the present invention. Alternatively, the enclosure material 325 and the bag film 315 could exchange place with each other in FIG. 8 and the soaker pad 328 would be positioned onto the bag film 315 by the soaker pad positioning and cutting mechanism 327 prior to the two web materials being sealed together as previously described above.

After the soaker pads 328 have been cut and positioned onto the perforated enclosure material 325, a continuous layer of preferably printed transparent bag film 315 is laid over the perforated enclosure material 325 thereby sandwiching the soaker pads 328 between the bag film 315 and the enclosure material 325. The width of the bag film 315 is preferably substantially wider than the width of the enclosure material 325 resulting in the enclosure material edges 325*a* and 325*b* being connected to the surface of the bag film 315 a substantial distance away from the bag film edges 315*a* and 315*b*.

As the enclosure material 325, containing the soaker pads 328 and the bag film 315, are fed forwardly, the enclosure material edges 325*a* and 325*b* are connected by heat sealing mechanism 370 to the surface of the bag film 315 forming seams 326*a* and 326*b* shown in FIG. 9. The seams 326*a* and 326*b* are formed adjacent to the edges 325*a* and 325*b* of enclosure material 325. Heat sealing mechanism 370 includes heat sealing devices 371 and 372 that seal the enclosure material edges 325*a* and 325*b* to the surface of the bag film 315 at seams 326*a* and 326*b* as they pass across back-up drum 375. Mechanisms such as mechanism 370 are well known in the art whereby some such mechanisms utilize devices to heat seal materials together by making direct contact to the materials to be connected while others do not make direct contact with the materials to be scaled but instead generate hot air to cause the materials to melt thereby heat sealing them together. Any device known in the art of heat sealing polymeric materials together could be utilized as the device to connect the materials together in the method of the present invention.

In addition to connecting the enclosure material 325 and the bag material 315 together at seams 326*a* and 326*b*, enclosure material 325 and bag material 315 could also be connected by several spot connections such as spot connections 377*a* and 377*b* formed conventional sealing mechanism 376. The spot connections 377*a* and 377*b* would prevent the soaker pads 328 from sliding between the surfaces of the enclosure material 325 and the bag film 315 along an axis parallel to the forming direction of the soaker pad web material 300. The spot connections 377*a* and 377*b* could be elongated spot connections or discontinuous seam connections or any connection type capable of limiting the movement of the pad during the bag forming process. Seams 326*a* and 326*b* also prevent the soaker pads 328 from slipping between the surfaces of the enclosure material 325 and the bag film 315 along an axis perpendicular to the forming direction of the soaker pad web material 300. Adhesives could be utilized to create the connections at seams 326*a*, 326*b* and at spots 377*a* and 377*b* as opposed to heat sealing. Adhesives used to connect polymeric materials together are well known in the art and any known adhesive could be utilized with the present invention.

Shown in FIG. 8A is an alternate method of positioning the soaker pad 328 between the enclosure material 325 and the bag film 315. This alternate method would feed the cut soaker pads 328 between two nip rollers such as 395 and 396. Roller 395 would feed enclosure material 325, and roller 396 feeds bag film 315, in the same direction indicated by the arrows in FIG. 8A, and the soaker pads 328 would be placed between enclosure material 325 and bag film 315 at bag length intervals.

Figure 10B:
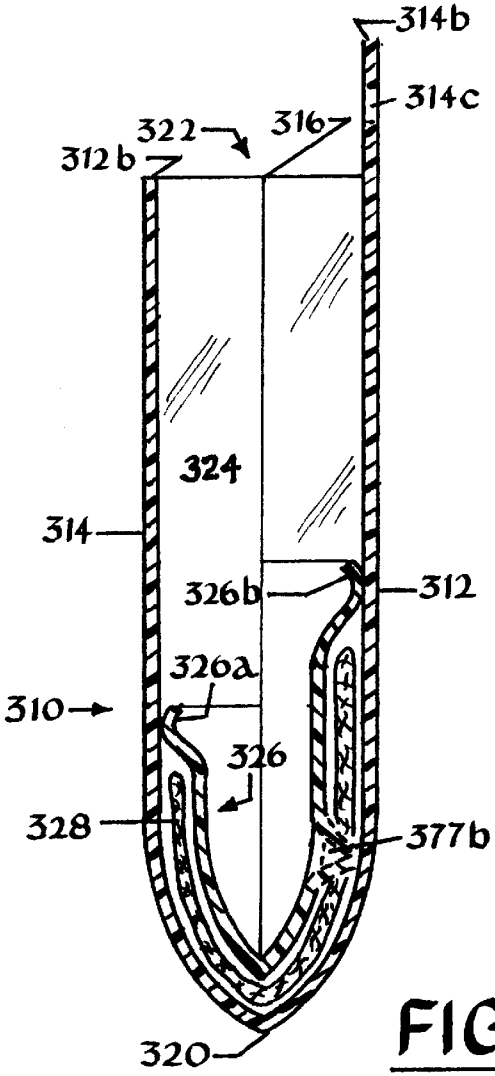
FIG. 10B is a cross sectional view taken along lines 10B—10B of FIG. 10A.
Figure 10A:
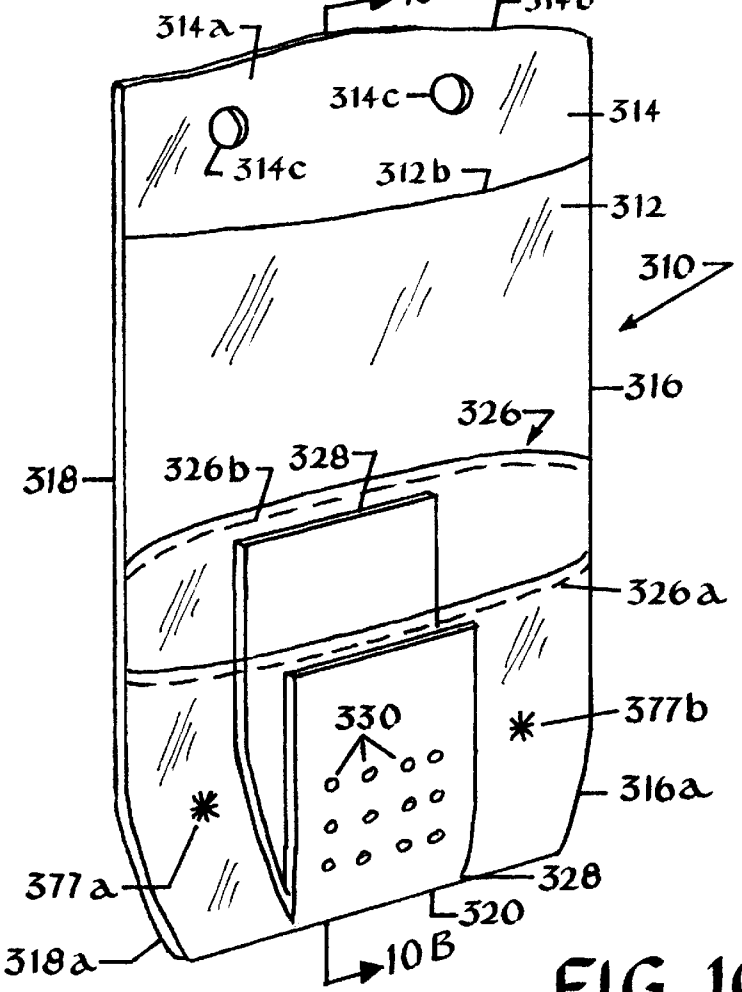
FIG. 10A is a perspective view of the fourth embodiment of the bag of the present invention.

Once the soaker pad web material 300 is fully formed as described above the method of the present invention would preferably include a conventional bag making machine 390 such as the bag making machine for making bags from the soaker pad web material. The bag making machine disclosed in U.S. Pat. No. 3,678,812, which is hereby incorporated by reference, may be used as the bag making machine 390. Bag making machine 390 for making bags would preferably include a conventional folding device generally indicated by the numeral 380. A conventional folding device 380 such as the folding device disclosed in U.S. Pat. No. 3,678,812. Folding device 380 folds the soaker pad web material 300 into preferably "J-sheeting" as is known in the art, with a first side 312*b* longer than a second side 314*b* to form a lip 314 on each resulting bag 310 as shown in FIGS. 10A and 10B. It would not be necessary to fold the soaker pad web material 300 so that one side is longer than the other, but instead, both sides could be of equal length. Machine 390 would include a conventional mechanism shown in U.S. Pat. No. 3,678,812 for cross sealing and cutting off soaker pad web material 300 to form a storage bag with soaker pad 310 as shown in FIG. 10A and 10B. Bag making machines such as bag machine 390 are well known in the art and any such machine could be utilized as the bag machine of the present invention.

Shown in FIG. 9 is soaker pad web material 300 comprising preferably a single continuous rectangular sheet of perforated enclosure material 325 including perforations 330 therein. However, perforated enclosure material could be formed from several pieces of material connected to each other along continuous longitudinal seams. Perforated enclosure material 325 is connected continuously adjacent to its edges 325*a* and 325*b* to bag film 315 to form seams 326*a* and 326*b*. Preferably, bag film 315 is transparent, rectangularly shaped, impervious plastic film 315. Sandwiched between the perforated enclosure material 325 and the bag film 315 are soaker pads 328. To prevent movement of the soaker pad 328 along a direction parallel to the enclosure material's edges 326*a* and 326*b* the enclosure material 325 is connected to the bag film at spot connections 377*a* and 377*b* on each side of soaker pad 328. Any number of connections of the type that limit the movement of the pad 328 between the enclosure material 325 and the bag film 315 could be included if desired. A single connection such as spot connection 377*a* positioned on only one side of each soaker pad 328 may be enough to prevent movement of the pad 328 depending on the web path utilized by the actual mechanisms chosen to perform the various functions required.

The bag film 315, perforated enclosure material 325, and soaker pads 328 used to make bags 10 and soaker pad web material 300 of the present invention could be treated with antimicrobial agents to control of the spread of microorganism such as those specifically listed above by using the techniques previously described for treating enclosure 26 of FIG. 1–3.

Referring now to FIGS. 10A and 10B, there is shown a fourth embodiment of the storage bag of the invention generally indicated by the numeral 310 made from soaker pad web material 300. Bag 310 has a front panel 312 and a rear panel 314 which are preferably made from a single, integral piece of transparent plastic film. Front panel 312 is joined to rear panel 314 by side seams 316 and 318 and by bottom fold 320. Side seams 316 and 318 have lower tapered portions 316*a* and 318*a*, respectively. However, the lower tapered portions 316*a* and 318*a* could be deleted and seams 316 and 318 could intersect bottom 320 perpendicularly if desired. Furthermore, rather than being formed in a straight line, the lower tapered portions 316*a* and 318*a* could be shaped like an arc or a portion of an ellipse.

Front panel 312 has a top edge 312*b* which is not connected to rear panel 314, and rear panel 314 has a top edge 314*b* which is not connected to front panel 312. Top edge 314*b* is located at a distance above top edge 312*b* to form lip 314*a*. Rear panel 314 may have wicket holes 314*c* adjacent the top edge 314*b* if desired for stacking the bags as is known in the art. If desired, top edge 312*b* and top edge 314*b* could lie immediately adjacent to each other, and lip 314*a* and wicket holes 314*c* could be eliminated.

Thus, an opening 322 shown in FIG. 10B is formed in the top end of bag 310. Goods such as poultry, beef, vegetables, or any other fluid exuding item may be inserted into the inside 324 of bag 310 through opening 322. Preferably, bag 310 is used to contain and store poultry. The poultry may be whole such as a cleaned and dressed chicken, or the poultry may be cut into pieces such as chicken quarters, or thighs, drumsticks, or wings.

Bag panels 312 and 314 of bag 310 shown in FIG. 10A and 10B could be treated with antimicrobial agents, to control the spread of microorganism found in bag 310, by using the techniques previously described for treating enclosure 26 of FIG. 1–3.

Located inside bag 310 is an enclosure made from preferably opaque plastic film generally indicated by the numeral 326 for loosely containing and hiding the fluid absorbing pad 328 and liquids emanating from goods stored in bag 310. Although it is preferred that fluid absorbing pad 328 may be loosely contained or held in enclosure 326 and therefore be free to move therein, pad 328 could be connected to enclosure 326 to prevent movement therein if desired.

The soaker pad 328 shown in FIG. 10A and 10B could be treated with antimicrobial agents to control the spread of microorganism such as those specifically listed above by using the techniques previously described for treating enclosure 26 of FIG. 1–3.

Enclosure 326 is connected at seam 326*a* to front panel 312 and at seam 326*b* to rear panel 314. Preferably, enclosure 326 is connected along its sides 326*c* and 326*d* as shown in FIG. 10A to side seams 316 and 318 of bag 310 and to tapered portions 316*a* and 318*a*, and at spots 377*a* and 377*b* to front panel 312. The size of the enclosure 326 is preferably less than half the size of the combination of the front panel 312 and back panel 314 of the bag 310.

In FIG. 10A and 10B, seams 326*a* and 326*b* are shown connected to front panel 312 and rear panel 314, respectively. As shown, seam 326*b* could be located a greater distance from the bottom fold 320 than seam 326*a* to coincide with the borders of printed matter that may appear on the front panel 312 and back panel 314 of bag 310. Furthermore, if desired, seam 326*a* or 326*b* could be located adjacent to bottom fold 320 or both seams 326*a* and 326*b* could be located on the same front panel 312 or the same back panel 314.

Perforations 330 permit liquids to travel therethrough from the goods contained in bag 310 to the soaker pad 328. Soaker pad 328 absorbs and retains the liquids from the goods. Furthermore, some of the liquids which may not be absorbed or retained by soaker pad 328 are retained within the enclosure 326 which functions as a fluid sump or reservoir. Perforations 330 could be spaced far enough away from seams 326*a* and 326*b* to create a dam at seams 326*a* and 326*b* to further facilitate enclosure 326 to function as a reservoir.

The enclosure 326 as shown in FIG. 10A and 10B is preferably treated with antimicrobial agents to control the spread of microorganism such as those specifically listed above by using the techniques previously described for treating enclosure 26 of FIG. 1–3.

Figure 11A:
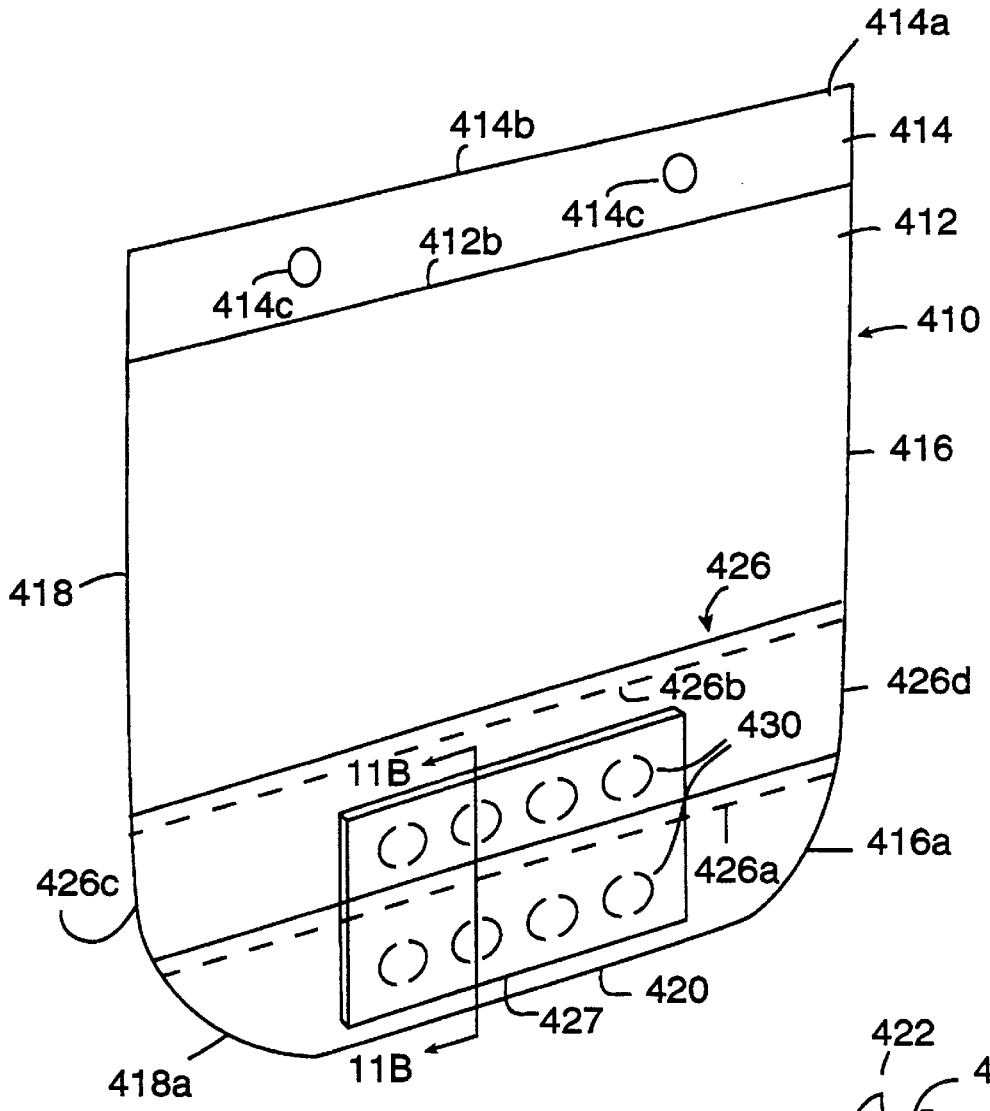
FIG. 11A is a perspective view of the fifth embodiment of the bag of the present invention.
Figure 11B:
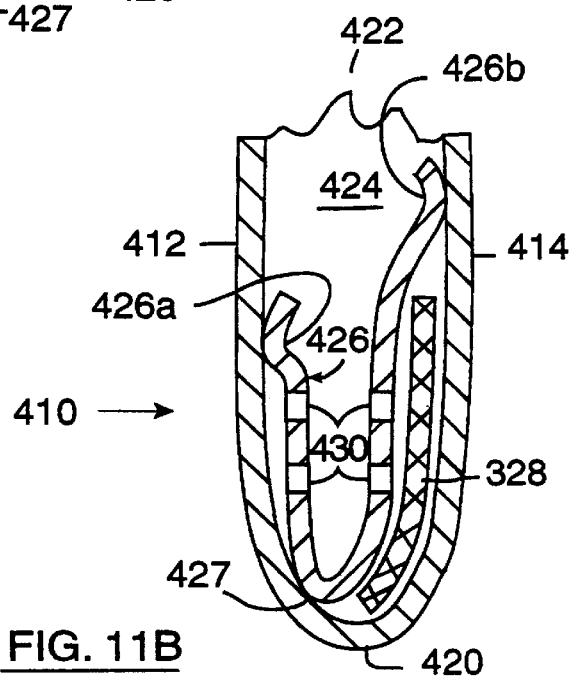
FIG. 11B is a cross sectional view taken along lines 11B—11B of FIG. 11A.

Referring now to FIGS. 11A and 11B, there is shown a fourth embodiment of the storage bag of the invention generally indicated by the numeral 410 made from bag material 300. Bag 410 has a front panel 412 and a rear panel 414 which are preferably made from a single, integral piece of transparent plastic film. Front panel 412 is joined to rear panel 414 by side seams 416 and 418 and by bottom fold 420. Side seams 416 and 418 have lower tapered portions 416*a* and 418*a*, respectively. However, the lower tapered portions 416*a* and 418*a* could be deleted and seams 416 and 418 could intersect bottom 420 perpendicularly if desired. Furthermore, rather than being formed in a straight line, the lower tapered portions 416*a* and 418*a* could be shaped like an arc or a portion of an ellipse.

Front panel 412 has a top edge 412*b* which is not connected to rear panel 414, and rear panel 414 has a top edge 414*b* which is not connected to front panel 412. Top edge 414*b* is located at a distance above top edge 412*b* to form lip 414*a*. Rear panel 414 may have wicket holes 414*c* adjacent the top edge 414*b* if desired for stacking the bags as is known in the art. If desired, top edge 412*b* and top edge 414*b* could lie immediately adjacent to each other, and lip 414*a* and wicket holes 414*c* could be eliminated.

Thus, an opening 422 shown in FIG. 11B is formed in the top end of bag 410. Goods such as poultry, beef, vegetables, or any other fluid exuding item may be inserted into the inside 424 of bag 410 through opening 422. Preferably, bag 410 is used to contain and store poultry. The poultry may be whole such as a cleaned and dressed chicken, or the poultry may be cut into pieces such as chicken quarters, or thighs, drumsticks, or wings.

Bag panels 412 and 414 of bag 410 shown in FIG. 11A and 11B could be treated with antimicrobial agents, to control the spread of microorganism found in bag 410, by using the techniques previously described for treating enclosure 26 of FIG. 1–3.

Located inside bag 410 is an enclosure made from preferably opaque plastic film generally indicated by the numeral 426 for loosely containing and hiding the fluid absorbing pad 428 and liquids emanating from goods stored in bag 410. Although it is preferred that fluid absorbing pad 428 may be loosely contained or held in enclosure 426 and therefore be free to move therein, pad 328 could be connected to enclosure 426 to prevent movement therein if desired.

The soaker pad 428 shown in FIG. 11A and 11B could be treated with antimicrobial agents to control the spread of microorganism such as those specifically listed above by using the techniques previously described for treating enclosure 26 of FIG. 1–3.

Preferably, enclosure 426 is sealed in any conventional manner such as spot welding or the like at 427 to front panel 412 near bottom 420 as shown in FIG. 11*b*, or to rear panel 414 near or at bottom told 420, to prevent the bottom of enclosure 426 from being displaced upwardly toward opening 422 during the bag forming process or when goods are removed from enclosure 426.

Enclosure 426 is connected at seam 426*a* to front panel 412 and at seam 426*b* to rear panel 414. Preferably, enclosure 426 is connected along its sides 426*c* and 426*d* as shown in FIG. 11A to side seams 416 and 418 of bag 410 and to tapered portions 416*a* and 418*a*, and at spot weld or seal 427 to front panel 412. The size of the enclosure 426 is preferably less than half the size of the combination of the front panel 412 and back panel 414 of the bag 410.

In FIG. 11A and 11B, seams 426*a* and 426*b* are shown connected to front panel 412 and rear panel 414, respectively. As shown, seam 426*b* could be located a greater distance from the bottom fold 420 than seam 426*a* to coincide with the borders of printed matter that may appear on the front panel 412 and back panel 414 of bag 410. Furthermore, if desired, seam 426*a* or 426*b* could be located adjacent to bottom fold 420 or both seams 426*a* and 426*b* could be located on the same front panel 412 or the same back panel 414.

Perforations 430 permit liquids to travel therethrough from the goods contained in bag 410 to the soaker pad 328. Soaker pad 328 absorbs and retains the liquids from the goods. Furthermore, some of the liquids which may not be absorbed or retained by soaker pad 328 are retained within the enclosure 426 which functions as a fluid sump or reservoir. Perforations 430 could be spaced a substantial distance away from seams 426*a* and 426*b* thereby creating a larger dam at seams 426*a* and 426*b* to further facilitate enclosure 426 to function as a reservoir.

The enclosure 426 as shown in FIG. 11A and 11B is preferably treated with antimicrobial agents to control the spread of microorganism such as those specifically listed above by using the techniques previously described for treating enclosure 26 of FIG. 1–3.

Figure 12A:
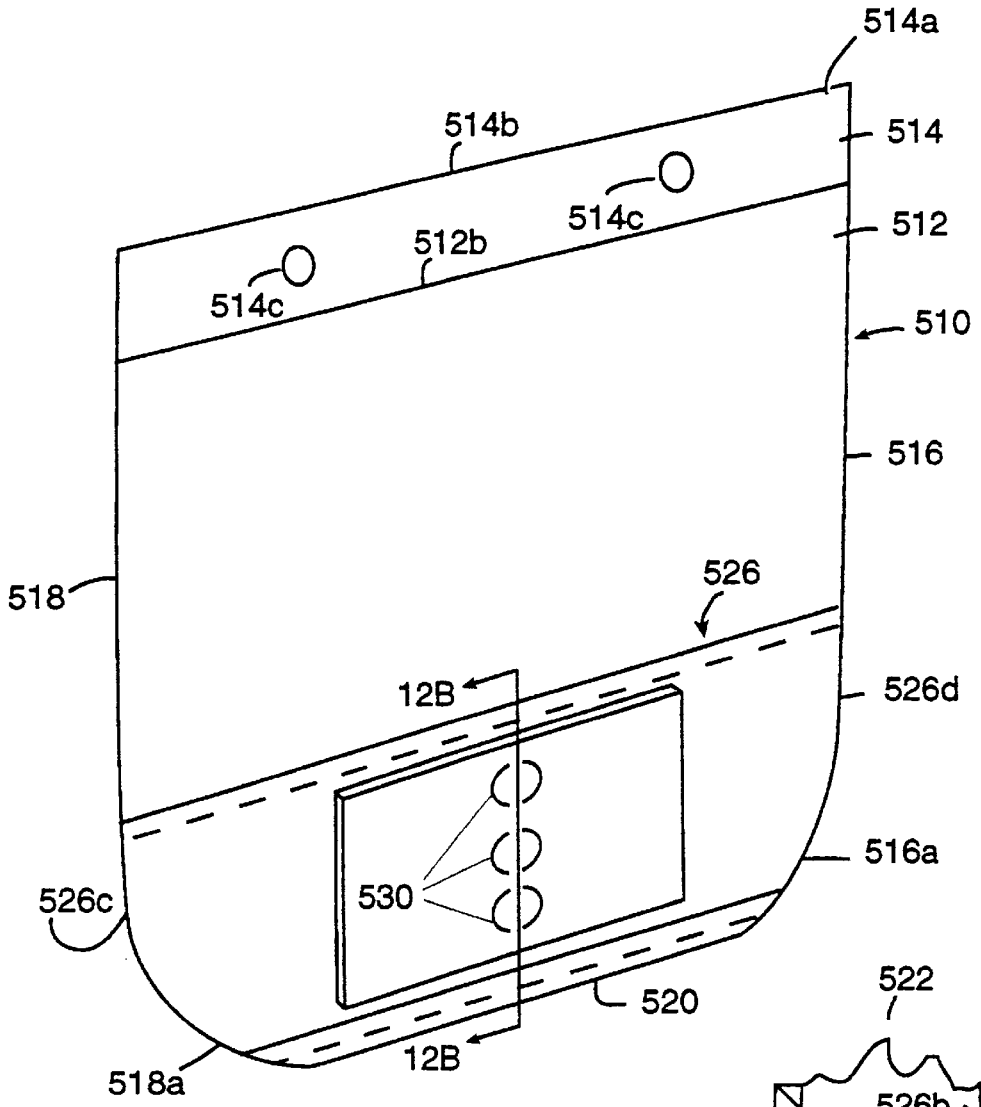
FIG. 12A is a perspective view of the sixth embodiment of the bag of the present invention.
Figure 12B:
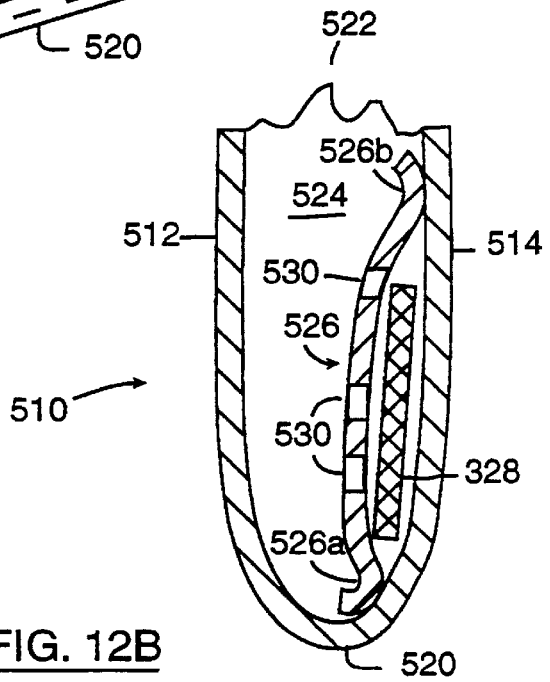
FIG. 12B is a cross sectional view taken along lines 12B—12B of FIG. 12A.

Referring now to FIGS. 12A and 12B, there is shown a fifth embodiment of the storage bag of the invention generally indicated by the numeral 510 made from bag material 300. Bag 510 has a front panel 512 and a rear panel 514 which are preferably made from a single, integral piece of transparent plastic film. Front panel 512 is joined to rear panel 514 by side seams 516 and 518 and by bottom fold 520. Side seams 516 and 518 have lower tapered portions 516*a* and 518*a*, respectively. However, the lower tapered portions 516*a* and 518*a* could be deleted and seams 516 and 518 could intersect bottom 520 perpendicularly if desired. Furthermore, rather than being formed in a straight line, the lower tapered portions 516*a* and 518*a* could be shaped like an arc or a portion of an ellipse.

Front panel 512 has a top edge 512*b* which is not connected to rear panel 514, and rear panel 514 has a top edge 514*b* which is not connected to front panel 512. Top edge 514*b* is located at a distance above top edge 512*b* to form lip 514*a*. Rear panel 514 may have wicket holes 514*c* adjacent the top edge 514*b* if desired for stacking the bags as is known in the art. If desired, top edge 512*b* and top edge 514*b* could lie immediately adjacent to each other, and lip 514*a* and wicket holes 514*c* could be eliminated.

Thus, an opening 522 shown in FIG. 12B is formed in the top end of bag 510. Goods such as poultry, beef, vegetables, or any other fluid exuding item may be inserted into the inside 524 of bag 510 through opening 522. Preferably, bag 510 is used to contain and store poultry. The poultry may be whole such as a cleaned and dressed chicken, or the poultry may be cut into pieces such as chicken quarters, or thighs, drumsticks, or wings.

Bag panels 512 and 514 of bag 510 shown in FIG. 12A and 12B could be treated with antimicrobial agents, to control the spread of microorganism found in bag 510, by using the techniques previously described for treating enclosure 26 of FIG. 1–3.

Located inside bag 510 connected to the inside of rear panel 514 is an enclosure made from preferably opaque plastic film generally indicated by the numeral 526 for loosely containing and hiding the fluid absorbing pad 328 and liquids emanating from goods stored in bag 510. Although it is preferred that fluid absorbing pad 328 may be loosely contained or held in enclosure 526 and therefore be free to move therein, pad 328 could be connected to enclosure 526 to prevent movement therein if desired.

The soaker pad 328 as shown in FIG. 12A and 12B could be treated with antimicrobial agents to control the spread of microorganism such as those specifically listed above by using the techniques previously described for treating enclosure 26 of FIG. 1–3.

Enclosure 526 is connected at seam 526*a* near the bottom 520 of rear panel 514 and at seam 526*b* to the upper portion of rear panel 514. If desired, enclosure 526 could be connected at seam 526*a* near the bottom 520 of front panel 512 and at seam 526*b* to the upper portion of front panel 512. Bottom seam 526*a* prevents the bottom of enclosure 526 from being displaced upwardly toward opening 522 during the bag forming process or when goods are removed from enclosure 526. Preferably, enclosure 526 is connected along its sides 526*c* and 526*d* as shown in FIG. 11A to side scams 516 and 518 of bag 510 and to tapered portions 516*a* and 518*a*. The size of the enclosure 526 is preferably less than half the size of the combination of the front panel 512 and back panel 514 of the bag 510.

In FIG. 12A and 12B, seams 526*a* and 526*b* are shown connected to rear panel 514. The perforations 530 permit liquids to travel therethrough from the goods contained in bag 510 to the soaker pad 328. Soaker pad 328 absorbs and retains the liquids from the goods. Furthermore, some of the liquids which may not be absorbed or retained by soaker pad 328 are retained within the enclosure 526 which functions as a fluid sump or reservoir. Perforations 530 could be spaced a substantial distance away from seam 526*a* thereby creating a larger dam at seams 526*a* to further facilitate enclosure 526 to function as a reservoir.

The enclosure 526 shown in FIG. 12A and 12B is preferably treated with antimicrobial agents to control the spread of microorganism such as those specifically listed above by using the techniques previously described for treating enclosure 26 of FIG. 1–3.

The enclosures, films, and bags of the invention are preferable constructed from a single piece of plastic film well known in the art. However, perforated enclosure material, film, and bags could be formed from several pieces of material connected to each other along continuous longitudinal seams. Preferably, the bag and enclosure of the invention are constructed from pieces of flexible thermoplastic film such as polyvinylidene chloride, polyethylene, polypropylene, and the like. A particularly preferred thermoplastic film is polyethylene.

The bags and film of the invention may be constructed by any method or methods known in the art. A preferred method of attaching the enclosures is by heat sealing, although other film attaching methods such the use of adhesives could also be used. Furthermore, the bags of the invention may be made in any desired shape. Preferably, the bags 10, 110 and 210 and 310 are generally rectangular in shape, as are the enclosures 26, 126, 226, and 310 and the soaker pads 28, 128 and 228. Although it is preferred that at least the enclosures for all the various embodiments described above contain antimicrobial agents to suppress the growth of microorganisms that may be found in within the bags of the invention, it should be understood that in addition to the enclosures the soaker pad and the material that forms the bag panels of the bags of the present invention could also contain antimicrobial agents.

Although the preferred embodiments of the invention have been described in detail above, it should be understood that the invention is in no sense limited thereby, and its scope is to be determined by that of the following claims.

What is claimed is:

1. A storage bag with soaker pad, said storage bag comprising:

a. a bag having a front and rear panel constructed from plastic film, said front and rear panels being closed along a fold at one end to form a bottom of said bag, said bag being open at the opposite end for receipt of goods to be stored in said bag;

b. an enclosure for containing and confining liquids emanating from goods stored inside said bag, said enclosure is less than half the length of the combined length of said front panel and said rear panel of said bag, said enclosure being folded to form a bottom fold and two walls, said enclosure being connected by continuous seams at all of its edges to the inside surface of both of said front and rear panels of said bag, said enclosure being connected to said bag such that said bottom fold of said enclosure is adjacent to said bottom fold of said bag, said walls of said enclosure are contiguous with the bottom portion of both of said front and rear panels, and the only connection between said enclosure and said bag other than said continuous seams are such that there is space between said walls of said enclosure and the inside surface of said bottom portion of both of said front and rear panels, said enclosure having a plurality of spaced apart perforations therein for conveying said liquids through said enclosure to said space between said walls of said enclosure and the interior surface of said bottom portion of said front and rear panels to which said enclosure is connected, said enclosure being treated with a antimicrobial agent for suppressing the growth of microorganisms that may be found in said liquids emanating from said goods stored in said bag, and c. a pad for absorbing said fluids that are located in said space between said walls of said enclosure and the interior of said bottom portion of said front and rear panels to which said enclosure is connected, said pad being located in said space between said walls of said enclosure and the interior surface of said bottom portion of said front and rear panels to which said enclosure is connected, said pad being smaller in volume than said space between said walls of said enclosure and the interior surface of said bottom portion of said front and rear panels to which said enclosure is connected, said enclosure totally enclosing said pad to define a first reservoir and a second reservoir for containing and confining said liquids, i. said first reservoir comprising said pad, and ii. said second reservoir comprising a sump, said sump being the portion of said space between said walls of said enclosure and the interior surface of said bottom portion of said front and rear panels to which said enclosure is connected that is not occupied by said pad.

2. The storage bag of claim 1 wherein said antimicrobial is specifically designed to suppress bacteria.

3. The storage bag of claim 1 wherein said pad is connected to said enclosure.

4. The storage bag of claim 1 wherein said pad is treated with an antimicrobial agent.

5. The storage bag of claim 1 wherein said enclosure contains perforations that are spaced a substantial distance away from said continuous seams.

6. The storage bag of claim 1 wherein said antimicrobial is specifically designed to suppress algae.

7. The storage bag of claim 1 wherein said antimicrobial is specifically designed to suppress fungus.

8. The storage bag of claim 1 wherein said front panel and said rear panel have been treated with an antimicrobial agent.

9. The storage bag of claim 1 wherein said pad is located in the space between said rear panel and said respective wall of said enclosure.

10. A storage bag with soaker pad, said storage bag comprising:

a. a bag having a front and rear panel constructed from plastic film, said front and rear panels being closed along a fold at one end to form a bottom of said bag, said bag being open at the opposite end for receipt of goods to be stored in said bag;

b. enclosure for containing and confining liquids emanating from goods stored inside said bag, said enclosure is less than half the length of the combined length of said front panel and said rear panel of said bag, said enclosure being connected by continuous seams at all of its edges to the inside surface of said bag, and the only connection between said enclosure and said bag other than said continuous seams are such that there is space between said walls of said enclosure and the inside surface of said panel to which said enclosure is connected, said enclosure having a plurality of spaced apart perforations therein for conveying said liquids through said enclosure to said space between said walls of said enclosure and the interior surface of said panel to which said enclosure is connected, said enclosure being treated with a antimicrobial agent for suppressing the growth of microorganisms that may be found in said liquids emanating from said goods stored in said bag, and c. pad for absorbing said fluids that are located in said space between said walls of said enclosure and the interior of said panel to which said enclosure is connected, said pad being located in said space between said walls of said enclosure and the interior surface of said panel to which said enclosure is connected, said pad being smaller in volume than said space between said walls of said enclosure and the interior surface of said bag to which said enclosure is connected, said enclosure totally enclosing said pad to define a first reservoir and a second reservoir for containing and confining said liquids, i. said first reservoir comprising said pad, and ii. said second reservoir comprising a sump, said sump being the portion of said space between said walls of said enclosure and the interior surface of said bag to which said enclosure is connected that is not occupied by said pad.

11. The storage bag of claim 10 wherein said antimicrobial agents is specifically designed to suppress bacteria.

12. The storage bag of claim 10 wherein said pad is connected to said enclosure.

13. The storage bag of claim 10 wherein said pad is treated with an antimicrobial agent.

14. The storage bag of claim 10 wherein said enclosure contains perforations that are spaced a substantial distance away from said continuous seams.

15. The storage bag of claim 10 wherein said antimicrobial agents are specifically designed to suppress algae.

16. The storage bag of claim 10 wherein said antimicrobial agents are specifically designed to suppress fungus.

17. The storage bag of claim 10 wherein said front panel and said rear panel have been treated with an antimicrobial agent.

18. The storage bag of claim 10 wherein said pad is located in the space between said rear panel and said respective wall of said enclosure.

19. A material for making storage bags with absorbent pads comprising:

a. a bag film with a first and a second longitudinal edge and a top end and a bottom end;

b. an enclosure material with a first and a second longitudinal edge, a top end and bottom end, and containing a plurality of spaced apart perforations, said enclosure material being substantially narrower than said bag film and having said first and second edges connected to the surface of said bag film along continuous seams located a substantial distance away from said edges of said bag film, said enclosure being treated with a antimicrobial agent for suppressing the growth of microorganisms that may be found in said liquids emanating from said goods stored in said bag; and c. a plurality of absorbent pads spaced at bag intervals and located in the space between said bag film and said enclosure material and said continuous seams.

20. The material of claim 19 wherein said antimicrobial is specifically designed to suppress bacteria.

* * * * *